US006170767B1

(12) United States Patent
Herold et al.

(10) Patent No.: US 6,170,767 B1
(45) Date of Patent: Jan. 9, 2001

(54) FUEL INJECTION VALVE

(75) Inventors: Stefan Herold, Bamberg; Georg Fischer, Frensdorf, both of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/367,621

(22) PCT Filed: Oct. 21, 1998

(86) PCT No.: PCT/DE98/03076

§ 371 Date: Nov. 3, 1999

§ 102(e) Date: Nov. 3, 1999

(87) PCT Pub. No.: WO99/31379

PCT Pub. Date: Jul. 24, 1999

(30) Foreign Application Priority Data

Dec. 17, 1997 (DE) ..... 197 56 103

(51) Int. Cl.[7] ..... B05B 1/30

(52) U.S. Cl. ..... 239/585.3; 239/585.1; 251/129.15

(58) Field of Search ..... 238/585.1, 585.3–585.5; 251/129.15, 129.21

(56) References Cited

U.S. PATENT DOCUMENTS 1,878,749 9/1932 Abramson .
4,964,389 * 10/1990 Eckert ..... 123/447
5,058,625 * 10/1991 Kaiser et al. ..... 137/624.15
5,088,467 2/1992 Mesenich .
5,890,477 * 4/1999 Nazare ..... 123/592
6,073,911 * 6/2000 Reiter ..... 251/129.15 X

FOREIGN PATENT DOCUMENTS 26 13 664 10/1977 (DE) .
33 14 899 10/1984 (DE) .
63 198769 8/1988 (JP) .
4-209964 7/1992 (JP) .

* cited by examiner

*Primary Examiner*—Lesley D. Morris
(74) *Attorney, Agent, or Firm*—Kenyon & Kenyon

(57) ABSTRACT

A fuel injection valve for fuel injection systems of internal combustion engines, in particular for direct injection of fuel into a combustion chamber of an internal combustion engine, has a magnet coil, an armature that can be moved by the magnet coil in a linear stroke direction toward a first return spring, and a valve needle joined to a valve closure element. In the linear stroke direction, the armature engages positively on the valve needle. In the opposite direction, the armature is freely movable independently of the valve needle toward a second return spring. The armature is bearing-mounted on the valve needle by way of at least one slide bearing having several balls.

10 Claims, 3 Drawing Sheets

FUEL INJECTION VALVE

BACKGROUND INFORMATION

The present invention is based on a fuel injection valve. German Published Patent Application No. 33 14 899 has already disclosed an electromagnetically actuable fuel injection valve in which, for electromagnetic actuation, an armature coacts with an electrically energizable magnet coil, and the linear stroke of the armature is transferred via a needle valve to a valve closure element. The valve closure element coacts with a valve seat surface in order to constitute a sealing fit. The valve needle is acted upon in the spray discharge direction by a first return spring, so that when the magnet coil is not energized, the valve closure element is held in sealing contact against the valve seat surface. The armature is not immovably joined to the valve needle, but rather is held, by a second return spring acting opposite to the spray discharge direction and in the linear stroke direction of the armature, against an entraining piece of the valve needle. When the linear stroke movement of the armature occurs, the valve needle is therefore entrained by the armature via the entraining piece, so that the valve closure element lifts off from the valve seat surface in order to open the fuel injection valve. Once the armature comes to a stop against the stop surface provided, after the linear stroke movement is complete, the valve needle can still move slightly toward the first return spring by the fact that the entraining piece lifts off from the armature. In this context, the movement direction of the valve needle is reversed by the first return spring. The armature bounces back slightly from the stop surface, its movement direction being reversed by the second return spring. The valve needle and the armature then strike against one another moving in opposite directions, and the kinetic energy of the two-mass, two-spring system is dissipated. Because of the kinematic separation of the armature and the valve needle, bouncing of the valve needle and the armature is thus greatly reduced by comarison with a usual fuel injection valve having the armature and valve needle immovably joined. The metering accuracy of the fuel injection valve can thereby be improved.

When the fuel injection valve known from German Published Patent Application No. 33 14 899 is closed, the armature also lifts off from the entraining piece of the valve needle when the valve needle is abruptly decelerated by impact of the valve closure element against the valve seat surface. The armature then moves toward the second return spring, which moves the armature back opposite to the closing direction until the armature is once again resting flush against the entraining piece of the valve needle. Bouncing of the fuel injection valve is thus greatly decreased in the closing direction as well.

In the fuel injection valve known from German Published Patent Application No. 33 14 899, however, there exists the disadvantage that the armature is guided in unsatisfactory fashion on the valve needle or on the entraining piece of the valve needle. Guidance is accomplished by the fact that the entraining piece of the valve needle is inserted into a corresponding bore of the armature. Because of the inaccuracy of the guidance, the effectiveness of the above-described debouncing of the fuel injection valve is therefore limited. In addition, the flow connection for the fuel in the region of the cup-shaped armature is attained in unsatisfactory fashion. Passthrough openings for the fuel are provided in the peripheral region of the bottom of the cup-shaped armature. The passthrough openings are arranged so that relatively high flow resistance for the fuel results, with the risk of creating undesirable turbulence.

SUMMARY OF THE INVENTION

The fuel injection valve according to the present invention has the advantage that friction between the armature and the valve needle is greatly reduced. At the same time, precise guidance of the valve needle on the armature, and conversely of the armature on the valve needle, is achieved. As a result of the at least one slide bearing according to the present invention between the armature and the valve needle, the kinematics of the two-mass, two-spring system is considerably improved, thus resulting in a fuel injection valve with particularly little bounce. At the same time, a particularly economical solution is arrived at, since the balls of the at least one slide bearing can be manufactured in particularly favorable fashion as a mass-produced product. The balls can be manufactured from hard bearing steel, which can be pressed into the soft ferromagnetic metal of the armature in a manner that is simple in terms of production engineering. The fact that the diameter of the balls can be produced accurately results in precise guidance of the valve needle on or in the armature.

According to a preferred embodiment, the armature has a stepped bore into which the balls of the two slide bearings that are provided can each be inserted at the ends. A passage provided between two enlargements of the stepped bore of the armature that receive the balls of the slide bearings allows the fuel to flow centrally through the armature, so that provision for the passage of fuel is made in particularly simple fashion with no need to provide additional bores, grooves, or flattened areas in or on the armature. At the same time, the fuel provides particularly effective lubrication of the balls of the slide bearings.

The enlargements of the stepped bore of the armature that receive the balls of the slide bearings can be closed off, after the balls have been inserted, by an edging of preferably annular configuration, in such a way that the balls cannot escape from the enlargements. The edging can be implemented in particularly simple and economical fashion in terms of production engineering, since the armature is preferably made from a ferromagnetic soft iron and is therefore relatively easy to work.

If the diameter of the balls of the slide bearings is substantially the same as the diameter of the valve needle that is of cylindrical configuration at least in this region, there results the advantage that the balls surround the valve needle in closely mutually adjacent fashion, so that the balls touch one another. The inside diameter of the slide bearing is then precisely defined by the diameter of the balls, inaccuracies in the production of the bore being compensated for by the armature.

If the valve needle has, as a stop for the balls of the slide bearing, a thickening with a continuously tapering transition segment whose radius of curvature is substantially the same as the radius of the balls, this has the advantage that the balls come to a stop against the thickening in relatively soft fashion.

DETAILED DESCRIPTION

Figure 1:
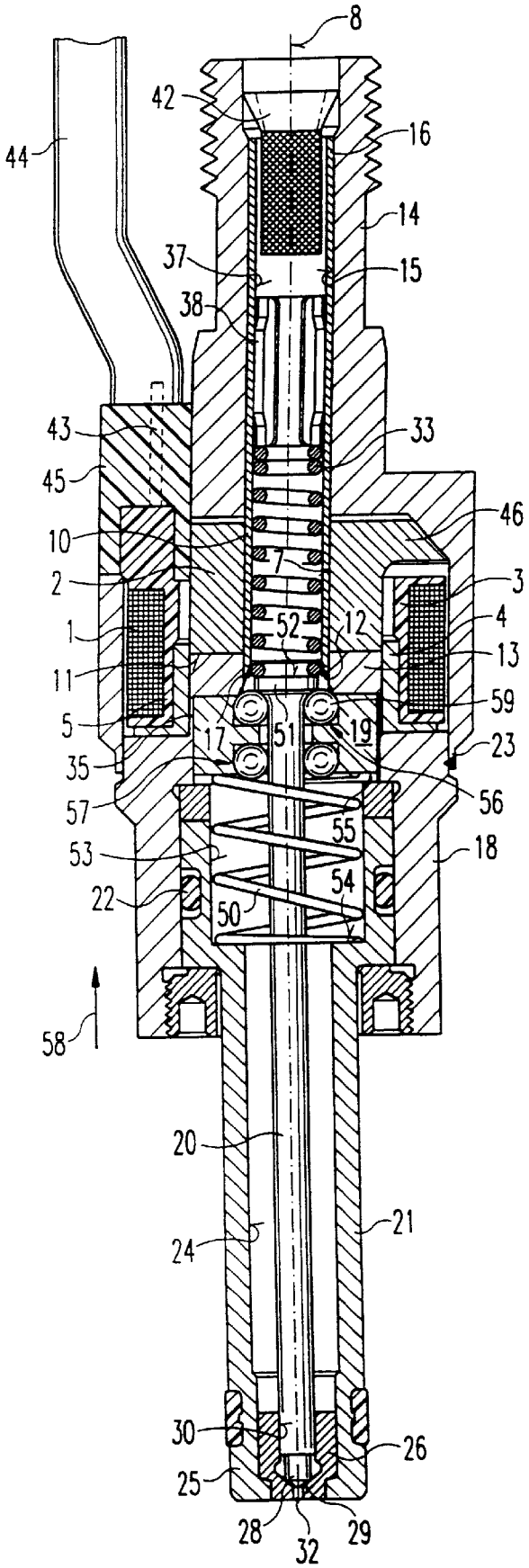
FIG. 1 shows a first exemplary embodiment of a fuel injection valve according to the present invention, in a sectioned depiction.

The electromagnetically actuable valve depicted by way of example in FIG. 1, in the form of an injection valve for fuel injection systems of mixture-compressing, spark-ignited internal combustion engines, has a tubular, largely hollow-cylindrical core 2 that is at least partially surrounded by a magnet coil 1 and serves as the inner pole of a magnetic circuit. The fuel injection valve is suitable in particular for direct injection of fuel into a combustion chamber of an internal combustion engine. A coil body 3, for example stepped, receives a winding of magnet coil 1 and makes possible, in conjunction with core 2 and an annular non-magnetic spacer 4 that has an L-shaped cross-section and is partially surrounded by magnet coil 1, a particularly short and compact configuration of the injection valve in the region of magnet coil 1. In this context, spacer 4 projects with one limb in the axial direction into a step 5 of coil body 3, and with the other limb radially along a lower (in the drawing) end surface of coil body 3.

Provided in core 2 is a continuous longitudinal opening 7 that extends along a longitudinal valve axis 8. Also running concentrically with longitudinal valve axis 8 is a thin-walled tubular sleeve 10 that projects through into internal longitudinal opening 7 of core 2 and is introduced in the downstream direction at least up to a lower end surface 11 of core 2. Sleeve 10 rests directly against the wall of longitudinal opening 7 or has a clearance with respect thereto, and possesses a sealing function with respect to core 2. Joined in immovable and sealed fashion to sleeve 10, which is nonmagnetic—e.g. made of corrosion-resistant CrNi steel, abbreviated V2A steel—is a ferritic pole element 13 of annular disk shape that rests against lower end surface 11 of core 2 and delimits core 2 in the downstream direction. Sleeve 10 and pole element 13, which is configured e.g. as a pressed part and is joined to sleeve 10 by welding or soldering, form in the direction of longitudinal valve axis 8 or in the downstream direction an encapsulation of core 2 which effectively prevents fuel from contacting core 2. Sleeve 10 projects, for example with its downstream end, as far as a shoulder 17 of an inner flowthrough opening 12 of pole element 13, and is, for example, joined to shoulder 17. Together with spacer 4, which is also joined in immovable and sealed fashion, e.g. by welding or brazing, for example to the limb of pole element 13 that runs in the axial direction, this encapsulation also ensures that magnet coil 1 remains completely dry when fuel is flowing through, and is not wetted with fuel.

Sleeve 10 also serves as a fuel delivery conduit, forming, together with an upper housing part 14 that is metallic (e.g. ferritic) and largely surrounds sleeve 10, a fuel inlet fitting. A passthrough opening 15, which for example has the same diameter as longitudinal opening 7 of core 2, is provided in housing part 14. Sleeve 10, which passes through housing part 14, core 2, and pole element 13 in the respective openings 7, 12, and 15, is not only immovably joined to pole element 13 but also joined in sealed and immovable fashion to housing part 14, e.g. by welding or crimping at upper end 16 of sleeve 10. Housing part 14 constitutes the inlet-side end of the fuel injection valve; envelops sleeve 10, core 2, and magnet coil 1 at least partially in the axial and radial direction; and extends, for example in the axial direction when viewed downstream, even beyond magnet coil 1. Adjoining upper housing part 14 is a lower housing part 18 that encloses or receives, for example, an axially movable valve part comprising an armature 19 and a valve needle 20 and valve seat support 21. The two housing parts 14 and 18 are immovably joined to one another in the region of lower end 23 of upper housing part 14, for example with a circumferential weld bead.

In the exemplary embodiment depicted in FIG. 1, lower housing part 18 and largely tubular valve seat support 21 are joined immovably to one another by thread-joining; welding, crimping, or soldering, however, also represent possible joining methods. Sealing between housing part 18 and valve seat support 21 is accomplished, for example, by way of a sealing ring 22. Valve seat support 21 possesses, over its entire axial extension, an inner passthrough opening 24 that runs concentrically with longitudinal valve axis 8. With its lower end 25, which also simultaneously represents the downstream termination of the entire fuel injection valve, valve seat support 21 surrounds a valve seat element 26 that is fitted into passthrough opening 24. Arranged in passthrough opening 24 is valve needle 20, which for example is rod-shaped and has a circular cross section, and has at its downstream end a valve closure element 28. This conically tapering valve closure element 28 coacts in known fashion with a valve seat surface 29 that is provided in valve seat element 26 and tapers in the flow direction in, for example, truncated conical fashion, and is configured in the axial direction downstream from a guide opening 30 present in valve seat element 26. Downstream from valve seat surface 29, at least one, but for example also two or four, outlet openings 32 for fuel is or are introduced into valve seat element 26. Flow regions (depressions, grooves, or the like) (not depicted), which ensure unimpeded fuel flow from passthrough opening 24 to valve seat surface 29, are provided in guide opening 30 and in valve needle 20.

The arrangement shown in FIG. 1 of lower housing part 18, valve seat support 21, and the movable valve part (armature 19, valve needle 20) represents only one possible variant embodiment of the valve assembly that follows the magnetic circuit in the downstream direction. It is emphasized that the widest possible variety of valve assemblies can be combined with the embodiment according to the present invention. In addition to valve assemblies of an inward-opening injection valve, it is also possible to use valve assemblies of an outward-opening injection valve. Spherical valve closure elements 28 or perforated spray disks are also conceivable in such valve assemblies. In the exemplary embodiment depicted, valve closure element 28 is configured integrally with valve needle 20. Valve closure element 28 can, however, also be configured as a separate component and joined to valve needle 20, for example, by welding, soldering, or the like.

Actuation of the injection valve is accomplished, in known fashion, electromagnetically. The electromagnetic circuit having magnet coil 1, core 2, pole element 13, and armature 19 provides for axial movement of valve needle 20 and thus for opening of the injection valve against the spring force of a first return spring 33 arranged in the interior of sleeve 10, and for closing thereof. Armature 19 is positively joined to the end of valve needle 20 facing away from valve closure element 28 only in the linear stroke direction, i.e. toward core 2, and in the opposite direction, i.e. toward valve closure element 28, is freely movable against a second return spring 50. Second return spring 50 holds armature 19, when the fuel injection valve is in the idle position, in contact against a thickening 51 of valve needle 20. Thickening 51 is configured at the end of valve needle 20 located opposite valve closure element 28. First return spring 33 engages at one end surface 52 of thickening 51. Guide opening 30 of valve seat element 26 serves to guide valve needle 20 during its axial movement along longitudinal valve axis 8. Armature 19 is guided during its axial movement in the accurately fabricated nonmagnetic spacer 4. As shown in the left side of FIG. 1, it is also possible, as an alternative to the separate embodiment of pole element 13 and lower housing part 18 that was described, to provide a one-piece version in which a narrow circumferential web 35 extends out from pole element 13 in the axial direction as a transition to housing part 18, and all the segments together (pole element 13, sleeve-shaped web 35, lower housing part 18) constitute a one-piece ferritic component. The inner delimiting surface of web 35 then correspondingly serves as a guide for armature 19.

An adjusting sleeve 38 is inserted or pressed or threaded into an inner flow bore 37 of sleeve 10, running concentrically with longitudinal valve axis 8, that serves to convey fuel toward valve seat surface 29. Adjusting sleeve 38 serves to adjust the spring preload of first return spring 33, that rests against adjusting sleeve 38 and in turn is braced, at its opposite end, against the upstream end surface 52 of thickening 51 of valve needle 20. Projecting on the inflow end into flow bore 37 of sleeve 10 is a fuel filter 42, which filters out those fuel constituents that, because of their size, might cause clogging or damage in the injection valve. Fuel filter 42 is immobilized in housing part 14, for example, by being pressed in.

The linear stroke of valve needle 20 is predefined by valve seat element 26 and pole element 13. One static end position of valve needle 20, when magnet coil 1 is not energized, is defined by contact of valve closure element 28 against valve seat surface 29 of valve seat element 26, while the other static end position of valve needle 20, when magnet coil 1 is energized, results from contact of armature 19 against pole element 13. The surfaces of the components in these stop regions are, for example, chrome-plated.

Electrical contacting to magnet coil 1, and thus energization thereof, are accomplished via contact elements 43 that are additionally equipped, even outside the actual coil body 3 that is made of plastic, with an injection-molded plastic sheath 45. The injection-molded plastic sheath can also extend over further components (e.g. housing parts 14 and 18) of the fuel injection valve. Extending out from injection-molded plastic sheath 45 is an electrical connector cable 44 through which current flows to magnet coil 1.

FIG. 1 shows one particularly advantageous embodiment of core 2. For this purpose, core 2 is embodied in tubular shape but not with a constant outside diameter. Only in the region of injection-molded plastic sheath 45 does core 2 possess a constant outside diameter over its entire axial extension. Outside injection-molded plastic sheath 45, core 2 is configured with a radially outward-facing collar 46 that extends partially in the manner of a cover over magnet coil 1. Injection-molded plastic sheath 45 thus projects through a groove in collar 46. Core 2 is preferably made of material that reduces eddy currents, for example a composite powder material.

Second return spring 50 extends in a cylindrical stepped segment 53 of passthrough opening 24 (configured as a stepped bore) of valve seat support 21, and is braced at its downstream end against a step 54 of through opening 24 (configured as a stepped bore) of valve seat support 21. At its upstream end, second return spring 50 acts upon a downstream end surface 55 of armature 19. Armature 19 is joined to valve needle 20 via an upstream slide bearing 56 and a downstream slide bearing 57.

The manner of operation of the fuel injection valve depicted in FIG. 1 is as follows:

When magnet coil 1 is energized, armature 19 is pulled toward core 2 until armature 19 comes to rest against pole element 13. Valve needle 20 and valve closure element 28—which is joined to valve needle 20 or, in the exemplary embodiment depicted, configured integrally with valve needle 20—are thereby also accelerated in the linear stroke direction characterized by arrow 58. Balls 59 of upstream slide bearing 56 rest positively against thickening 51 of valve needle 20, so that valve needle 20 and thus also valve closure element 28 are entrained by the linear stroke movement of armature 19. In the idle state, there exists between armature 19 and pole element 13 a slight gap (not visible in FIG. 1) that defines the valve stroke. As soon as armature 19 has been lifted off by the magnetic field sufficiently far in linear stroke direction 58 that it comes to a stop against pole element 13, it is abruptly decelerated and bounces back slightly from pole element 13 opposite to linear stroke direction 58. Valve needle 20 and valve closure element 28 joined to valve needle 20, on the other hand, initially continue, because of their inertial mass, to move in linear stroke direction 58 toward first return spring 33. This is made possible by the fact that armature 19 engages positively on valve needle 20 only in linear stroke direction 58. Thickening 51 of valve needle 20 can therefore lift off from balls 59 of upstream slide bearing 56, which in the exemplary embodiment depicted constitute the stop surface; the balls of the two slide bearings 56 and 57 slide on the enveloping surface of cylindrically shaped valve needle 20.

The movement of valve needle 20 opposite to linear stroke direction 58 is reversed by first return spring 33, while the movement direction of armature 19, initially running toward linear stroke direction 58 after armature 19 has bounced back, is reversed by second return spring 50. Valve needle 20 with valve closure element 28, and armature 19, are consequently once again moving toward one another after the movement reversal, the inertial mass of armature 19, the inertial mass of valve needle 20 and valve closure element 28, and the spring constants of the two return springs 33 and 50 preferably being designed so that when armature 19 and valve needle 20 encounter one another again, the impact energy dissipates almost completely. Bouncing of the fuel injection valve is thus greatly diminished, as compared to a conventionally configured fuel injection valve, by the separation of armature 19 from valve needle 20, and by the creation of a two-mass, two-spring system. Slide bearings 56 and 57 according to the present invention ensure that the kinematic motion proceeds essentially undisturbed by frictional influences. At the same time, precise guidance of valve needle 20 on armature 19 is achieved by way of slide bearings 56 and 57.

Once the flow of current to magnet coil 1 has stopped, armature 19 and valve needle 20 are accelerated by first return spring 33 in the closing direction until valve closure element 28 comes to a stop against valve seat surface 29 of valve seat element 26. The bouncing that occurs in conventional fuel injection valves is reduced, with the embodiment according to the present invention, by the fact that armature 19 swings back in the closing direction toward second return spring 50. Second return spring 50 then guides armature 19 back in linear stroke direction 58 until balls 59 of upstream slide bearing 56 come to rest against thickening 51 of valve needle 20. The fuel injection valve is then ready for the next opening cycle. Since the mass of armature 19 is substantially greater than the mass of valve needle 20 and valve closure element 28, the kinematic separation of the movements of armature 19 and valve needle 20 results in effective suppression of bouncing of the fuel injection valve. Slide bearings 56 and 57 according to the present invention effectively reduce sliding friction between armature 19 and valve needle 20, so that armature 19 can slide in free and unimpeded fashion on the enveloping surface of valve needle 20. Guidance of valve needle 20 on armature 19 is maintained because of the highly precise fit of slide bearings 56 and 57.

The relative movement of armature 19 with respect to valve needle 20 described above is much greater in the closing direction than in the opening direction, and can be negligible in the opening direction due to the low inertial mass of valve needle 20.

Figure 2:
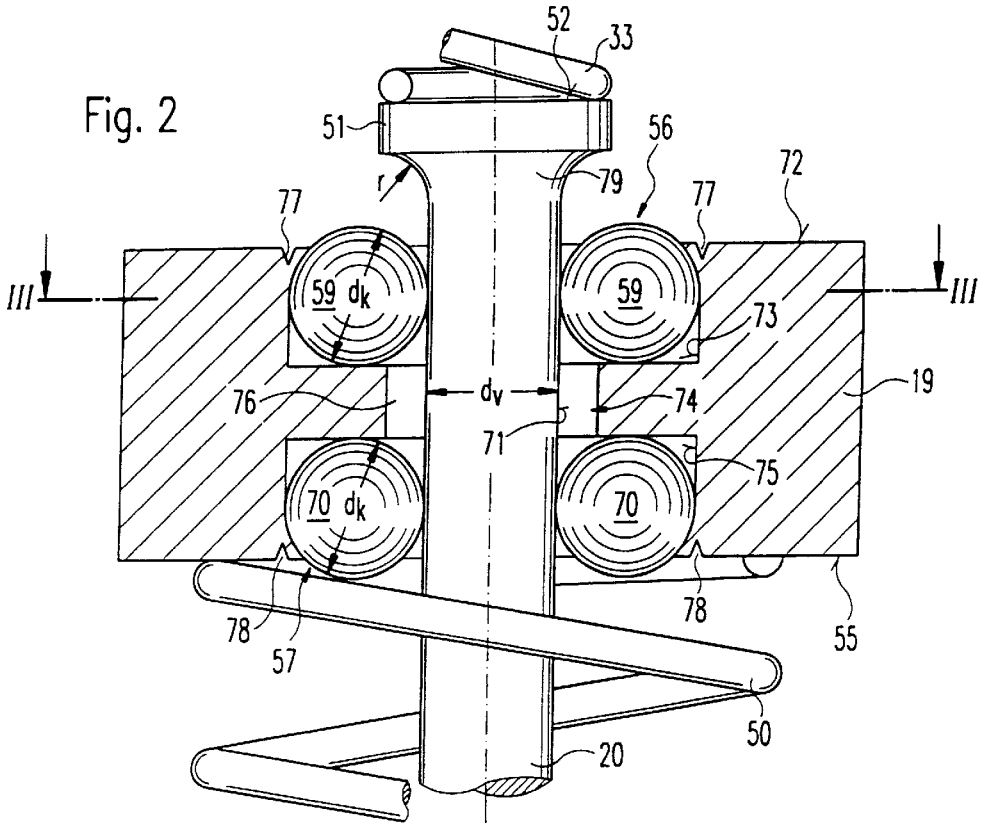
FIG. 2 shows an enlarged portion of the armature, the valve needle, and the return springs corresponding to the exemplary embodiment depicted in FIG. 1, in according to a partially sectioned depiction.

FIG. 2 depicts armature 19, the upstream portion of valve needle 20, first return spring 33, and second return spring 50 in enlarged fashion for better comprehension of the invention. Elements already described are labeled with identical reference characters.

FIG. 2 does not depict the idle state in which armature 19 engages positively against valve needle 20 by the fact that balls 59 of upstream slide bearing 56 are pressed by second return spring 50 against thickening 51 of valve needle 20; instead, it shows an operating state in which armature 19 is displaced with respect to valve needle 20. In this context, balls 59 of upstream slide bearing 56 and balls 70 of downstream slide bearing 57 slide on enveloping surface 71 of valve needle 20, which is of cylindrical configuration at least in the region of armature 19.

In the exemplary embodiment depicted, armature 19 has a stepped bore 74 to receive balls 59 of upstream slide bearing 56 and balls 70 of downstream slide bearing 57. In the exemplary embodiment, stepped bore 74 joins upstream end surface 72 of armature 19 to downstream end surface 55 of armature 19. At upstream end surface 72, stepped bore 74 widens into an upstream enlargement 73 into which balls 59 of upstream slide bearing 56 are pressed. Stepped bore 74 correspondingly widens at downstream end surface 55 into a downstream enlargement 75 into which balls 70 of downstream slide bearing 57 are pressed. The diameter of the annular enlargements 73 and 75 equals the sum of two ball diameters $d_k$ of balls 59 and 70 and the diameter $d_v$ of valve needle 20, which is of cylindrical configuration in the region of armature 19. Valve needle 20 is thus guided against armature 19 in practically zero-clearance fashion by balls 59 and 70 of the two slide bearings 56 and 57. Since balls 59 and 70 of slide bearings 56 and 57 can be manufactured with high accuracy, the result is extremely precise bearing guidance of valve needle 20.

In the exemplary embodiment, upstream enlargement 73 opening at upstream end surface 72, and downstream enlargement 75 opening at downstream end surface 55, are joined by a passage 76 that is part of stepped bore 74. The diameter of passage 76 is greater than diameter $d_v$ of valve needle 20, so that passage 76 is not completely filled up by valve needle 20. This allows fuel to flow axially through stepped bore 74 of armature 19. Fuel flows in the region of upstream enlargement 73 past circumferentially distributed balls 59, through passage 76, into downstream enlargement 75, and therein past balls 70 that are also circumferentially distributed. No additional features, such as additional axial bores, circumferential grooves, or flattened areas, therefore need to be provided for fuel flow in the region of armature 19, so that production costs can be further decreased.

After balls 59 of upstream slide bearing 56 have been pressed in, the rim at upstream end surface 72 is edged over by way of an edging indicated by reference character 77, so that balls 59 cannot escape from enlargement 73. Edging 77 is preferably of annular configuration. In the same way, the rim of downstream enlargement 75 is edged over, by way of an edging also preferably of circumferential annular configuration and indicated by reference character 78, in such a way that balls 70 of downstream slide bearing 57 cannot escape from downstream enlargement 75. Since armature 19 is preferably produced from a ferromagnetic or ferritic soft metal that is easy to machine, edgings 77 and 78 can be implemented without major production outlay. Balls 59 and 70, on the other hand, can be made from a hardened bearing steel and can additionally be coated on their running surfaces, for example, by chrome-plating.

In the idle state depicted in FIG. 1, balls 59 of upstream slide bearing 56 rest flush against a transition segment 79 of thickening 51 that continuously tapers toward armature 19. Transition segment 79 preferably has a radius of curvature r that equals half the diameter $d_k$ of balls 59 of upstream slide bearing 56, i.e. the radius of balls 59 is substantially identical to the radius of curvature r of transition segment 79. This has the advantage that when the fuel injection valve is in the idle position, balls 59 rest flush against the surface of transition segment 79 over a larger area, and are not subject to point loads due to any edges.

Passage 76 can also have the same diameter as enlargements 73 and 75, so that the bore of armature 19 is of unstepped configuration. This has the advantage of simplifying manufacture.

Figure 3:
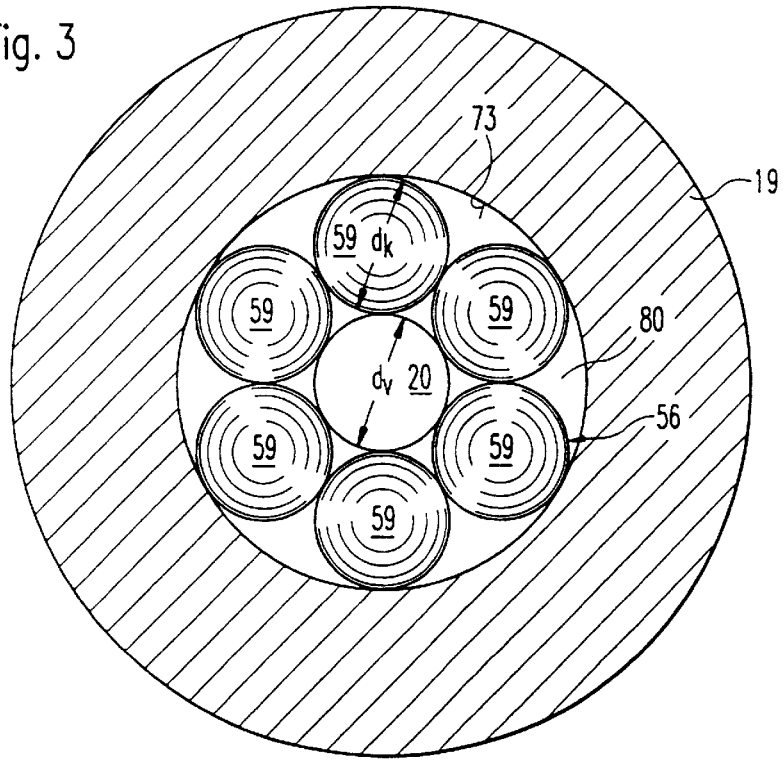
FIG. 3 shows a section along line III—III in FIG. 2.

FIG. 3 depicts, for better comprehension of the invention, a section along line III—III of FIG. 2. To facilitate orientation, elements already described are labeled with identical reference characters.

It is apparent from FIG. 3 that a particular advantage results if the diameter $d_k$ of balls 59 of upstream slide bearing 56, and also of balls 70 of downstream slide bearing 57, is identical to the diameter $d_v$ of valve needle 20 that is of cylindrical configuration in the region of armature 19. This ensures that balls 59 or 70 completely or at least almost completely fill up the annular space of enlargement 73 or 75. Balls 59 are therefore uniformly distributed in the annular space of enlargement 73, and further actions to align balls 59 are not necessary. It is also evident from FIG. 3 that sufficient interstices 80 remain between balls 59 to allow fuel to pass through. The flow of fuel through slide bearing 56 and slide bearing 57 moreover results in advantageous lubrication of slide bearings 56, 57.

The relatively hard balls 59 and 70 are pressed into the relatively inaccurately fabricated bore of armature 19. The inside diameter of slide bearings 56 and 57 is defined exclusively by ball diameter $d_k$, if the balls rest closely against one another. The inside diameter $d_v$ of slide bearings 56 and 57 constituted by the six balls 59 and 70 corresponds exactly to the diameter $d_k$ of the individual balls 59 and 70. The inside diameter $d_v$ of slide bearings 56 and 57 therefore depends substantially on the production tolerance of the ball diameter $d_k$. Since the production tolerance of balls $d_k$ is substantially tighter than the production tolerance of the diameter of the bore of armature 19 into which balls 59 and 70 are pressed, the overall result is highly accurate guidance in slide bearings 56 and 57 according to the present invention.

Figure 4:
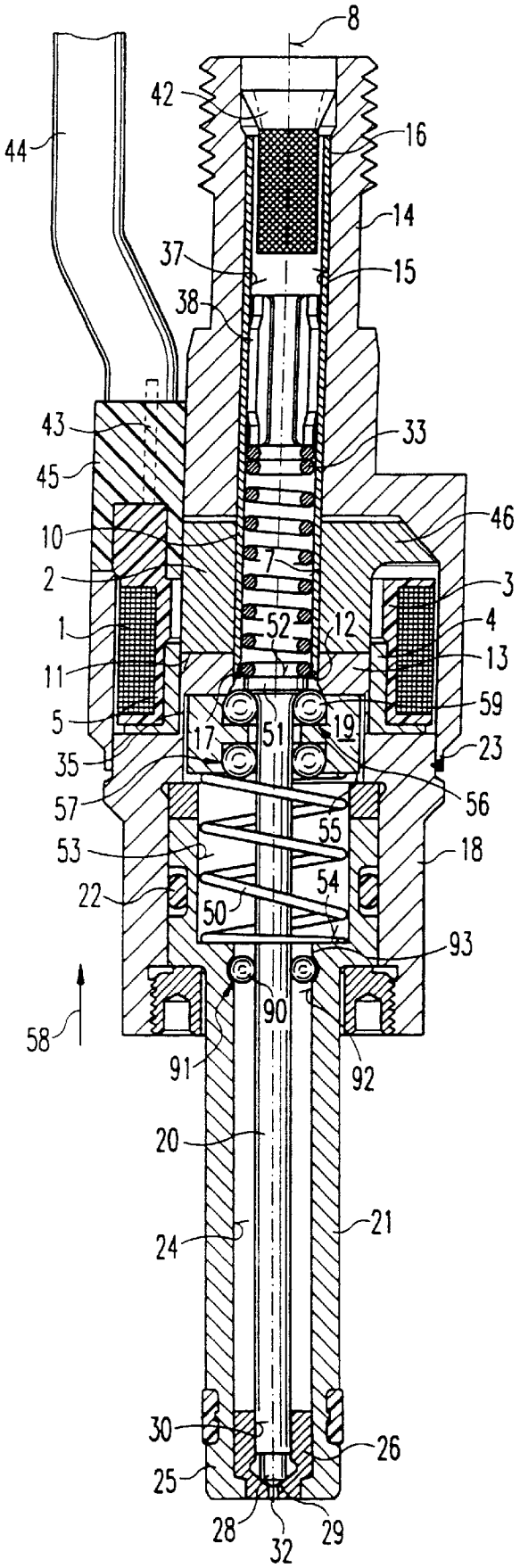
FIG. 4 shows a second embodiment of the fuel injection valve according to the present invention, in a sectioned depiction.

FIG. 4 shows a broadened exemplary embodiment that is substantially identical to the exemplary embodiment depicted in FIG. 1 and already described. The broadening consists in the fact that valve needle 20 is mounted in additional balls 90, arranged in valve seat support 21, of a further slide bearing 91. As a result, valve needle 20 is guided in valve seat support 21 by way of slide bearing 91. Armature 19 is configured with a somewhat smaller diameter as compared to the exemplary embodiment depicted in FIG. 1, so that its enveloping surface is not, in contrast to the exemplary embodiment depicted in FIG. 1, guided in spacer 4. Instead, upstream guidance of the component comprising valve needle 20 and armature 19 is accomplished in the additional slide bearing 91.

In the exemplary embodiment depicted in FIG. 4, passthrough opening 24 has a constriction 92 downstream from slide bearing 91. A constriction 93, which can be produced, for example, by edging over after balls 90 have been inserted, is provided upstream from balls 90 of slide bearing 91. Constrictions 92 and 93 effect axial immobilization of balls 90 of slide bearing 91 in passthrough opening 24.

The invention is not limited to the exemplary embodiments depicted. In particular, it may be sufficient for armature 19 to be bearing-mounted on valve needle 20 using only a single slide bearing rather than two slide bearings. Armature 19 need not necessarily come to a stop against valve needle 20 by way of balls 59. It is also possible, for example, for a projection of armature 19 to come to a stop against thickening 51 or another segment of valve needle 20 in order to entrain valve needle 20 positively in linear stroke direction 58. In addition, slide bearings 56 and 57 can also be configured as a separate prefabricated component, and mounted on armature 19, for example, by way of welds.

What is claimed is:

1. A fuel injection valve for a fuel injection system of an internal combustion engine that provides a direct injection of a fuel into a combustion chamber of the internal combustion engine, comprising:

a magnet coil;

a first return spring;

a second return spring;

a valve needle;

an armature that is movable in a linear stroke direction by the magnet coil in a linear stroke direction toward the first return spring, the armature engaging positively on the valve needle in the linear stroke direction and being freely movable independently of the valve needle toward the second return spring in a direction that is opposite to the linear stroke direction;

a valve closure element joined to the valve needle; and at least one slide bearing including a plurality of balls by which the armature is mounted on the valve needle.

2. The fuel injection valve according to claim 1, wherein the valve needle and the plurality of balls of the at least one slide bearing are inserted into a bore of the armature.

3. The fuel injection valve according to claim 2, wherein:

the at least one slide bearing includes a plurality of slide bearings each including the plurality of balls, the armature is bearing-mounted on the valve needle by way of the plurality of slide bearings, each one of the plurality of slide bearings being arranged at a respective end of the armature, the bore of the armature is formed as a stepped bore, and the plurality of balls of the plurality of slide bearings are respectively inserted into enlargements of the stepped bore arranged at respective ends of the armature.

4. The fuel injection valve according to claim 3, wherein the stepped bore includes between the enlargements a passage that is not completely occupied by the valve needle.

5. The fuel injection valve according to claim 3, wherein the enlargements of the stepped bore are closed off by edgings that are shaped after an insertion of the plurality of balls of the plurality of slide bearings such that the plurality of balls of the plurality of slide bearings cannot escape from the enlargements of the stepped bore.

6. The fuel injection valve according to claim 5, wherein the edgings surround the enlargements in an annular fashion at respective end surfaces of the armature.

7. The fuel injection valve according to claim 1, wherein a diameter of each one of the plurality of balls of the at least one slide bearing is substantially identical to a diameter of the valve needle, the valve needle having a cylindrical configuration in a region of the armature.

8. The fuel injection valve according to claim 1, wherein:

the at least one slide bearing includes at least a first slide bearing and a second slide bearing, the valve needle includes a thickening located at an end of the valve needle that is opposite to an end of the valve needle to which the valve closure element is joined, and one of the armature and the first slide bearing is held in contact by the second return spring on the thickening.

9. The fuel injection valve according to claim 8, wherein:

the plurality of balls includes a first plurality of balls associated with the first slide bearing and a second plurality of balls associated with the second slide bearing, the thickening includes a continuously tapering transition segment against which the first plurality of balls of the first slide bearing come to a stop, and the thickness includes a radius of curvature substantially identical to the radius of each one of the first plurality of balls of the first slide bearing.

10. The fuel injection valve according to claim 1, further comprising:

a valve seat support surrounding the valve needle; and a further slide bearing including another plurality of balls, the other plurality of balls being inserted into the valve seat support in order to achieve a bearing-mounting of the valve needle in the valve seat support.

* * * * *